US005394582A

United States Patent [19]

Moon

[11] Patent Number: 5,394,582

[45] Date of Patent: Mar. 7, 1995

[54] SAFETY CONTROL SYSTEM OF A BOILING CLOTHES WASHING MACHINE

[75] Inventor: Kyung H. Moon, Kyungki, Rep. of Korea

[73] Assignee: Samsung Electronics Co., Ltd., Suwon, Rep. of Korea

[21] Appl. No.: 176,471

[22] Filed: Jan. 3, 1994

Related U.S. Application Data

[62] Division of Ser. No. 963,392, Oct. 19, 1992.

[30] Foreign Application Priority Data

Oct. 19, 1991 [KR] Rep. of Korea ..... 9118473

[51] Int. Cl.[6] ..... D06F 39/04

[52] U.S. Cl. ..... 8/158; 68/12.21; 68/15

[58] Field of Search ..... 219/437, 492, 497, 508, 219/517; 134/57 D, 105–108; 68/15, 16, 12.03, 12.02, 12.21, 12.22; 392/441, 442, 444–445, 497, 498; 340/589; 8/158

[56] References Cited

U.S. PATENT DOCUMENTS

| | | | |
|---|---|---|---|
| 3,614,385 | 10/1971 | Horstmann | 219/303 |
| 4,405,855 | 9/1983 | Kolle et al. | 219/501 |
| 4,580,421 | 4/1986 | Baubin et al. | 68/12 R |
| 4,668,856 | 5/1987 | Axelson | 219/497 |
| 4,752,671 | 6/1988 | Foster et al. | 219/330 |
| 4,929,930 | 5/1990 | Rezabek | 340/622 |
| 5,099,108 | 3/1992 | Kimura et al. | 219/497 |

FOREIGN PATENT DOCUMENTS

| | | | |
|---|---|---|---|
| 0277551 | 8/1988 | European Pat. Off. . | |
| 2730865 | 1/1979 | Germany | 68/12.22 |
| 53-14286 | 8/1978 | Japan . | |

*Primary Examiner*—Philip H. Coe

*Attorney, Agent, or Firm*—Burns, Doane, Swecker & Mathis

[57] ABSTRACT

A safety control system and method for a boiling clothes washing machine has a number of paired washing water temperature detecting devices and heater temperature detecting devices, for accurately detecting the actual temperature of wash water so it will have a sufficient boiling effect on clothes to be washed and for preventing a heater from over-heating.

4 Claims, 2 Drawing Sheets

SAFETY CONTROL SYSTEM OF A BOILING CLOTHES WASHING MACHINE

This application is a divisional of application Ser. No. 07/963,392, filed Oct. 19, 1992.

BACKGROUND OF THE INVENTION

The present invention relates to a safety system of a boiling clothes washing machine for processing clothing with boiling or hot water, and particularly, to a safety control system of a boiling clothes washing machine and a system control method thereof for accurately detecting the temperature of wash water and the temperature of a heater to promote the safety of the system.

FIG. 1 is an illustrative example showing a number of safety devices installed on the bottom surface of a tub in accordance with the present invention, but it is referred to herein because it facilitates an explanation of the background art as well. A conventional washing machine includes a heater 2 mounted between the inner bottom of the tub 1 and the outer bottom of a wash tank 7. The tub 1 includes a metal bracket 3 which projects upward through the bottom surface of the tub 1 with a fight seal being kept between the bracket 3 and the bottom surface of the tub 1. The lower portion of the metal bracket 3 has an opening in the form of a box to receive a thermistor $Th_1$ and a thermostat 36. The heater 2 is always in contact with the upper surface of the bracket 3 in a manner to be immersed. Therefore, the thermistor $Th_1$ and the thermostat 36 detect the temperature of wash water and the heater to enable the heater 2 to be controlled. That is, the temperature detected by the thermistor $Th_1$ is first compared to the temperature of the wash water and then to the temperature of the heater 2 to control the operation of the heater 2. If it is determined that the thermistor $Th_1$ is out of order or has realfunctioned, the thermostat 36 is then required to control the operation of the heater 2.

A conventional safety apparatus only detects the surface temperature of the metal bracket 3, which is taken to be the temperature of the wash water. However, a large error arises between the actual and detected temperatures of the wash water due to the intervening thermal transferring medium, which in this case is the metal bracket 3. For example, the thermistor $Th_1$ may sense that the surface temperature of the metal bracket 3 has increased by about 95° C., causing the power source of the heater 2 to be cut off. However, the actual temperature of the wash water at this point is normally about 50° C. As a result, the conventional washing machine launders clothing with only warm water. The warm water is not expected to wash terribly dirty clothes at the desired optimal cleaning level. It is known through user's experience that the boiling clothing process, in which terribly dirty clothes are allowed to stand in hot water of over 95° C., is a very effective cleaning method. Therefore, it is necessary to accurately detect whether the temperature of wash water is over 95° C.

Thus, it is a main object of the present invention to provide a safety control system and method of a boiling clothes washing machine for accurately detecting the actual temperature of the wash water, controlling a heater based on the detected temperature and performing the boiling wash at a very high temperature.

It is another object of the present invention to provide a safety control system and method of a boiling clothes washing machine for preventing a heater from over-heating while washing clothes with boiling or hot water.

SUMMARY OF THE INVENTION

In order to achieve these objects and features, the present invention comprises a safety control system for a boiling clothes washing machine including a heater mounted through a bracket between a tub and a wash tank, so that the heater heats wash water to process clothing with hot water. The safety control system comprises first wash water temperature detecting means mounted at a location of the inner bottom of the tub that provides contact with wash water to be heated, for detecting the temperature of the wash water. The system also has second wash water temperature detecting means mounted at a location of the inner bottom of the tub that provides contact with the wash water to be heated, for detecting the temperature of the wash water, for controlling the operation of the heater during an abnormal operation of the first means. The system also has first heater temperature detecting means mounted on the outer upper surface of the bracket to contact with the heater, for detecting the temperature of the heater; and second heater temperature detecting means mounted on the outer upper surface of the bracket to contact with the heater, for detecting the temperature of the heater to control the operation of the heater during an abnormal operation of the first heater temperature detecting means.

Thus, the present invention permits the first and second wash water temperature detecting means to detect the actual temperature of wash water at the normal level of wash water over the height of the heater so as to control the operation of the heater. Similarly, the first and second heater temperature detecting means detect the actual temperature of the heater when wash water is at an abnormal level below the height of the heater, so as to control the operation of the heater.

BRIEF DESCRIPTION OF THE DRAWINGS

The present invention will be explained in detail with reference to the attached drawings, in which.

DETAILED DESCRIPTION OF THE INVENTION

Figure 1:
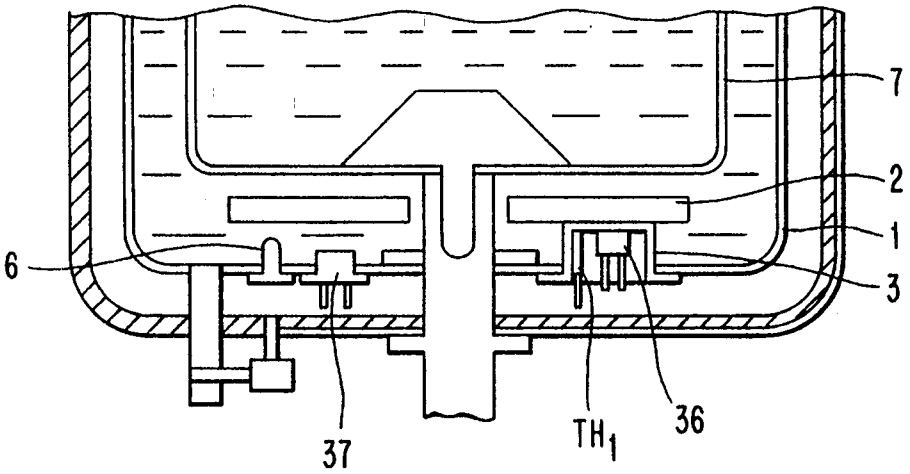
FIG. 1 is an illustrative example showing the mounting of a number of safety devices on the inner bottom surface of a tub according to the present invention; and, FIG. 2 is a schematic block diagram showing a safety control system according to the present invention.

As shown in FIG. 1, this embodiment uses a thermistor $Th_1$ as a first heater temperature detecting device, and a thermostat 36, as a second heater temperature detecting device. These heater temperature detecting devices sense the over-heating of a heater 2 in order to control the operation of the heater 2 when wash water is supplied to a level that is below the position of the heater 2. Such a configuration has already been explained.

Furthermore, first and second wash water temperature detecting devices are respectively constituted as a thermistor 6 and a thermostat 37, which are appropriately mounted on the inner bottom surface of a tub 1 where they will come into contact with the wash water. The thermistor 6 and the thermostat 37 detect the actual temperature of the wash water for controlling the operation of the heater 3 when wash water is supplied to a level that is above the position of the heater 2.

Figure 2:
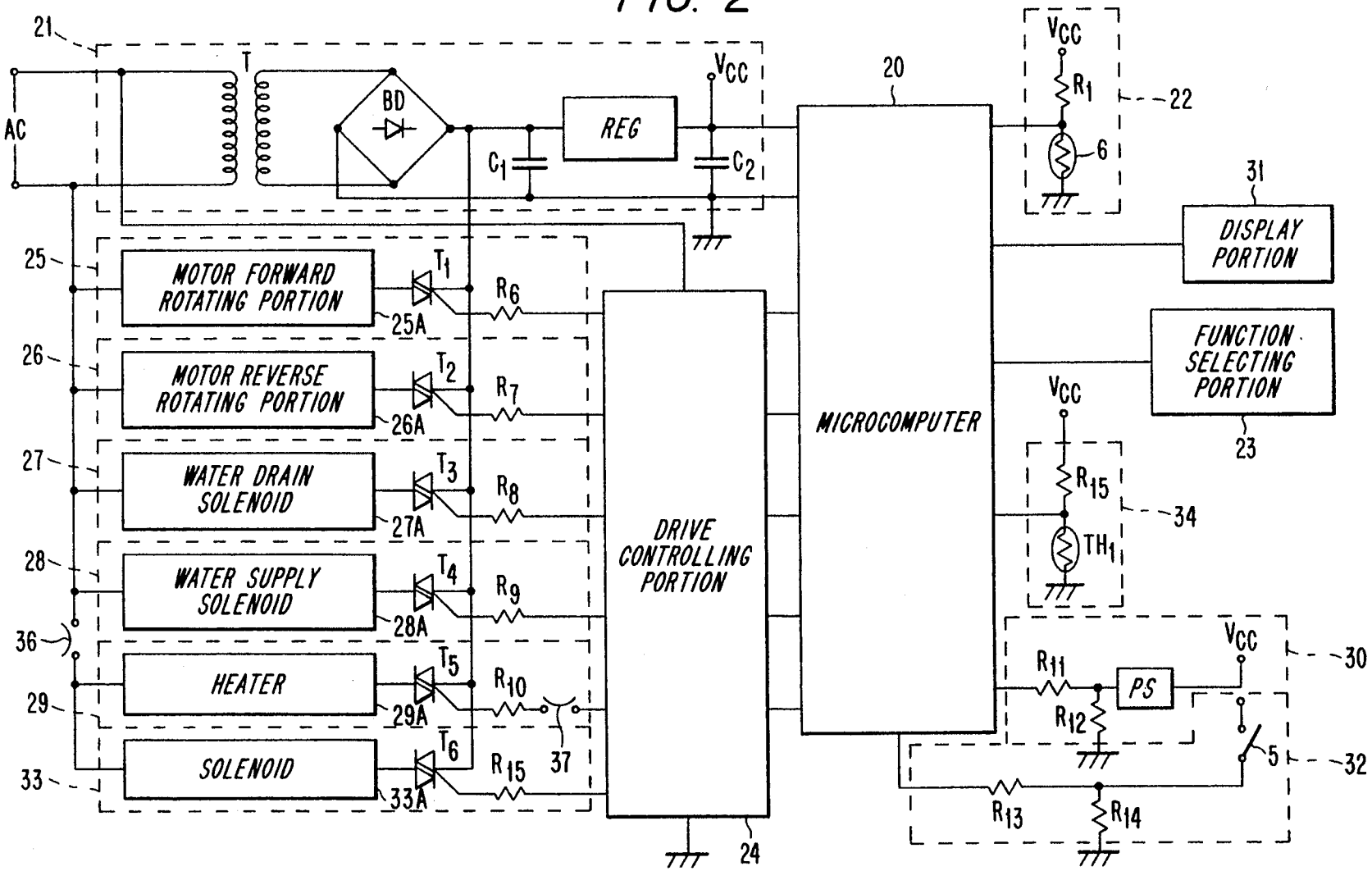

FIG. 2 is a safety control system circuit including a number of safety devices that have been adapted to function in accordance with the present invention. The safety control system circuit is provided with a microcomputer 20 for controlling the total operation of a boiling clothes washing machine according to a predetermined system program.

A power source supply portion 21 is provided with a transformer T, a bridge diode portion BD, condensers $C_1$ and $C_2$ and a precision regulator REG to rectify the alternate current into the constant power source for supplying the regulated voltage Vcc to the system.

A wash water temperature detecting portion 22 according to the present invention is provided with a thermistor 6 and a resistor $R_1$ for sensing the temperature of wash water to be supplied to a tub 1.

A function selecting portion 23 selects the wash mode or procedure and the operating times that correspond to each mode or procedure.

A drive controlling portion 24 operates a number of loads under the control of the microcomputer 20 according to the output signals from the wash water temperature detecting portion 22 and the function selecting portion 23.

A motor forward rotation drive portion 25 includes a motor forward rotation portion 25A for rotating the motor in a forward direction, a triac $T_1$ triggered by the output signal from the drive controlling portion 23, and a resister $R_6$.

A motor reverse rotation drive portion 26 includes a motor reverse rotation portion 26A for rotating the motor in a reverse direction, a triac $T_2$ triggered by the output signal from the drive controlling portion 23, and a resister $R_7$.

A water drain drive portion 27 includes a water drain solenoid valve 27A for draining wash water, a triac $T_3$ triggered by the output signal from the drive controlling portion 23, and a resistor $R_8$.

A water supply drive portion 28 includes a water supply solenoid valve 28A for supplying wash water, a triac $T_4$ triggered by the output signal from the drive controlling portion 23, and a resister $R_9$.

A heater operating portion 29 includes a heater 2 for heating wash water, a triac $T_5$ triggered by the output signal from the drive controlling portion 23, and a resister $R_{10}$.

A water level sensing portion 30 is provided with a pressure sensor PS and resisters $R_{11}$ and $R_{12}$ to sense the level of wash water to be supplied.

A display portion 31 displays the completion of each of the washing procedures, the function selection and so on.

A tub cover opening/closing portion 32 includes a tub cover sensing switch 5 for sensing the opening and closing of the tub cover, and resisters $R_{13}$ and $R_{14}$.

A tub cover locking/releasing portion 33 includes a solenoid 33 for locking and releasing the tub cover, a triac $T_6$ triggered by the output signal from the drive controlling portion 23, and a resister $R_{11}$.

A heater temperature detecting portion 34 according to the present invention includes a resister $R_{15}$, and a thermistor $Th_1$ for detecting the temperature of the heater 2 in the heater operating portion 29.

A thermostat 36 is connected between the heater operating portion 29 and one side of the transformer T for cutting off the power source of the heater 2 in the event of an abnormal operation of the thermistor $Th_1$ or a temperature of the heater 2 that is above a predetermined level.

A thermostat 37 is connected between the drive controlling portion 24 and the resistor $R_{10}$ of the heater operating portion 29 for cutting off the power source of the heater operating portion 29 in the event of an abnormal operation of the thermistor 6 or a temperature of the wash water that is above a predetermined level.

During operation, the system program controls the system so that the selection of a boiling wash function causes the boiling clothes washing machine to process clothes with hot water in a manner that is the same as in machines being controlled by other washing procedures.

In other words, the drive controlling portion 24 causes the water supply drive portion 28 to supply wash water into the tub 1 according to the output signals of the microcomputer 20. At this time, wash water is supplied to the tub 1 so that it rises to a level that is above the position of the heater 2. The amount of wash water supplied is dependent upon the volume of clothes to be washed. Then, after all of the wash water has been supplied, the heater operating portion 29 is activated so that the heater 2 will heat the wash water. When the wash water reaches a first temperature, for example about 95° C., the power source to the heater 2 is cut off. This is accomplished by using the thermistor 6 to detect the temperature of the wash water. In the event that the temperature of the wash water rises above the first temperature for cutting off the heater power source due to the malfunction of the thermistor 6, the thermostat 37 then detects the temperature of the wash water and sends the detected temperature data to the microcomputer 20. The microcomputer 20 determines whether the temperature of the wash water has reached a second temperature for cutting off the heater power source, for example 97° C. The power source supply of the heater 2 is automatically cut off at 97° C.

In the event of a malfunction or failure of the water level sensor 30 and the microcomputer 20, an insufficient amount of wash water may be supplied to the tub 1, so that the wash water level is lower than the position of the heater 2. In this case, the thermistor 6 and the thermostat 37 cannot detect the temperature of the heater 2, even under an over-heating situation, because they are installed at a location that is spaced away from the heater 2. Therefore, it is not possible to rely on the thermistor 6 and the thermostat 37 to cut off the power source of the heater 2. But, the thermistor $Th_1$ and the thermostat 36 are mounted in the metal bracket 3 in contact with the heater 2 according to the present invention. These elements detect the temperature of the heater 2 to enable the microcomputer 20 to determine whether the heater 2 is operating. First, the thermistor $Th_1$ detects the temperature of the heater 2. If the detected temperature reaches a first over-heating temperature for cutting off the heater power source due to the malfunction of the thermistor 6, the thermostat 36 then detects the temperature of the heater 2 and sends the detected temperature data to the microcomputer 20. The microcomputer 20 determines whether the temperature of the heater 2 has reached a second over-heating temperature for cutting off the heater power source, for example 108° C. The power source supply of the heater 2 is automatically cut off at 108° C.

In the preferred embodiment, each of a washing water temperature detecting device and a heater temperature detecting device includes a pair consisting of a thermistor and a thermostat. That is why the thermistor has a resistance value proportional to the temperature contrary to the thermostat prolonged for a long period until the normal operation after being turned off. First, the power source supply to the heater can be swiftly cut off based on the detected temperature data, after two thermistors detect the temperatures of washing water and the heater, respectively. Second, if two thermostats detect the over-heating temperature of washing water and the heater during the failure of a water level sensor and a microcomputer, they automatically stop supplying the power source to the heater.

The control method of a safety system is as follows:

During operation, the system program controls the system so that the selection of a boiling wash function causes a boiling clothes washing machine to process clothes with hot water in a manner that is the same as in other machines being controlled by other washing procedures.

The drive controlling portion 24 causes the water supply drive portion 28 to supply wash water into a tub 1 according to the output signals of the microcomputer 20. At this time, wash water is supplied to the tub 1 so that it rises to a level that is above the position of the heater. The amount of wash water supplied is dependent upon the volume of clothes to be washed. After all of the wash water has been supplied, the heater operating portion 29 is activated so that the heater 2 will heat the wash water. The microcomputer 20 then detects the temperature gradient of the heater through a thermistor $Th_1$. If the temperature gradient is over 13° C./min, the microcomputer 20 concludes that the wash water is supplied below the position of the heater 2 and tums off the operation of all loads. However, if the temperature gradient is below 13° C./min, the microcomputer 20 concludes that the wash water is supplied to a normal level and controls the operation of the heater 2 to maintain the first cutoff temperature of a heater power source based on the temperature data detected by a thermistor 6 of a wash water detecting portion 22.

As described above, according to the present invention a safety control system and method of a boiling clothes washing machine comprises a number of paired wash water temperature detecting devices and heater temperature detecting devices, for accurately detecting the actual temperature of wash water so it will have a sufficient boiling effect on clothes to be washed, and for preventing a heater from over-heating.

What is claimed is:

1. A method for controlling a heating operation of a clothes washing machine including a tub and a heater for washing clothes with hot water, comprising the steps of:

supplying a quantity of wash water into the tub in response to selection of a boiling wash mode, said quantity of wash water corresponding to a volume of clothes to be washed;

activating said heater to heat said quantity of wash water;

detecting a heater temperature and a wash water temperature; cutting off a power source to said heater alternatively in response to said detected heater temperature and said detected wash water temperature.

2. The method of claim 1, wherein the step of cutting off a power source to said heater comprises the steps of:

calculating a temperature gradient value from measurements of said detected heater temperature taken during a predetermined time interval, said temperature gradient being defined as a rate of temperature change;

comparing the calculated temperature gradient value with a reference temperature gradient value; and initiating said cutting off of said power source to said heater in response to said calculated temperature gradient value being greater than said reference temperature gradient value.

3. The method of claim 1, wherein the step of cutting off a power source to said heater comprises:

initiating said cutting off of said power source in response to a detection that said detected heater temperature is greater than a first reference heater temperature; and initiating said cutting off of said power source in response to a detection that said detected heater temperature is greater than a second reference heater temperature.

4. The method of claim 1, wherein the step of cutting off a power source to said heater comprises:

initiating said cutting off of said power source in response to a detection that said detected wash water temperature is greater than a first reference water temperature; and initiating said cutting off of said power source in response to a detection that said detected wash water temperature is greater than a second reference water temperature.

* * * * *